United States Patent [19]

Rokop et al.

[11] 4,144,928

[45] Mar. 20, 1979

[54] CONTINUOUS CASTING APPARATUS WITH REMOVABLE MOLD

[75] Inventors: Joseph Rokop, Bethel Park; Geoffrey W. Hughes, McMurray, both of Pa.

[73] Assignee: Rokop Corporation, Pittsburgh, Pa.

[21] Appl. No.: 892,172

[22] Filed: Mar. 31, 1978

[51] Int. Cl.[2] ..... B22D 11/04

[52] U.S. Cl. ..... 164/418; 164/137; 164/341; 164/342

[58] Field of Search ..... 164/339, 341, 342, 82, 164/137, 418; 269/94

[56] References Cited

U.S. PATENT DOCUMENTS

| | | | |
|---|---|---|---|
| 1,758,733 | 5/1930 | Cayo | 269/94 |
| 2,898,713 | 8/1959 | Jansson | 269/94 X |
| 3,374,826 | 3/1968 | Black, Jr. | 164/82 |
| 3,435,884 | 4/1969 | Orris et al. | 164/341 |
| 3,550,672 | 12/1970 | Fastert et al. | 164/418 |
| 3,559,720 | 2/1971 | Vogel et al. | 164/418 |
| 3,565,155 | 2/1971 | Vertesi et al. | 164/416 X |
| 3,757,405 | 9/1973 | Kurth et al. | 164/418 X |
| 3,823,761 | 7/1974 | Bode, Jr. | 164/418 |
| 4,069,863 | 1/1978 | Hargassner et al. | 164/341 X |

FOREIGN PATENT DOCUMENTS

| | | | |
|---|---|---|---|
| 47-41210 | 10/1972 | Japan | 164/418 |

*Primary Examiner*—Othell M. Simpson
*Assistant Examiner*—J. Reed Batten, Jr.
*Attorney, Agent, or Firm*—Brown, Flick & Peckham

[57] ABSTRACT

A continuous casting apparatus mold table supports a plate that in turn supports a mold extending through both. The table has opposite side walls extending above the plate, with each side wall supporting a shaft extending lengthwise of it between it and the plate and carrying lugs that overlap the adjacent marginal portion of the plate to clamp it on the table when the shaft is turned in the right direction and locked against reverse rotation. When the shafts are released, the plate and mold can be lifted past the lugs and removed from the table.

5 Claims, 4 Drawing Figures

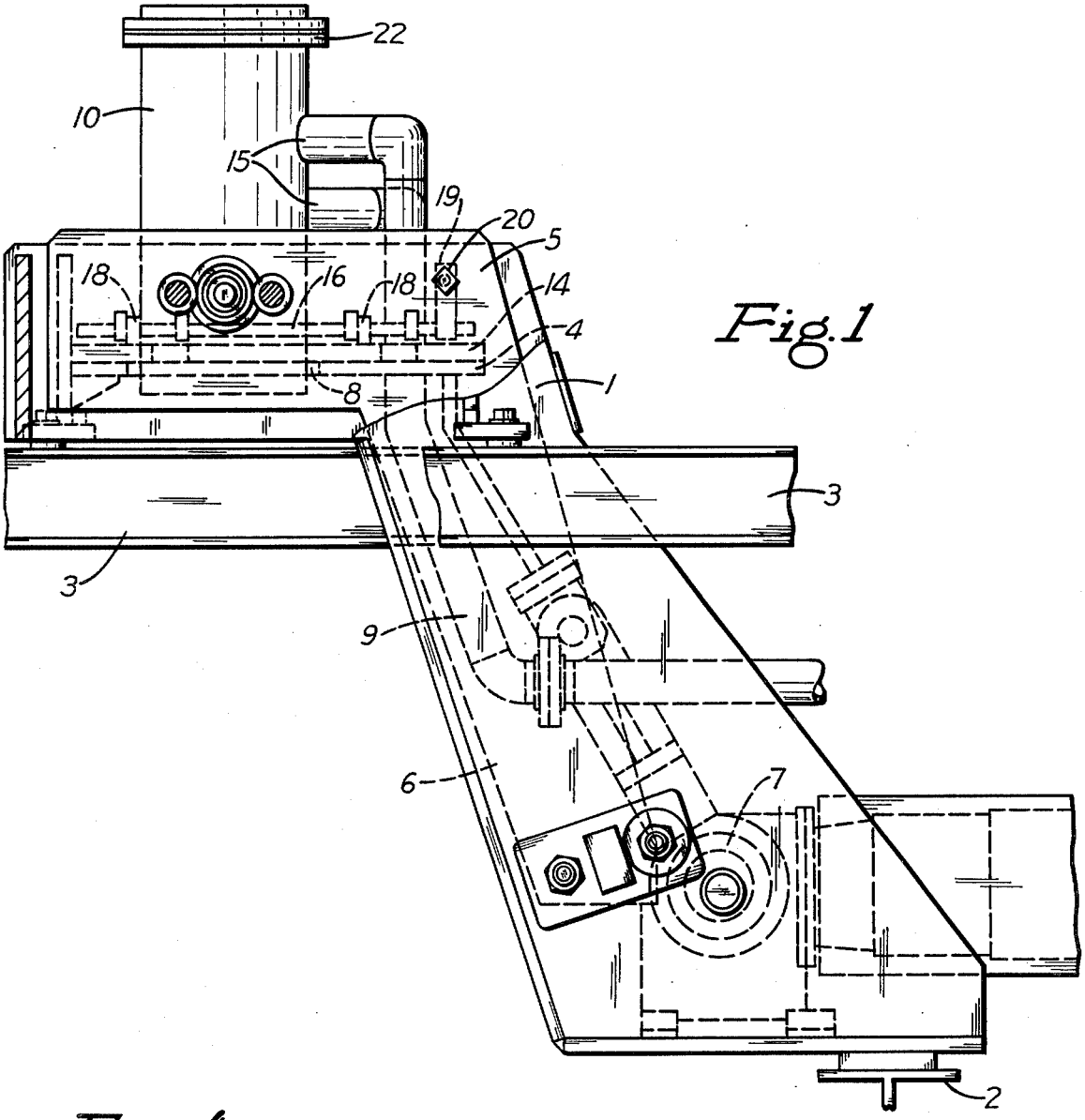
Fig. 1
Fig. 4
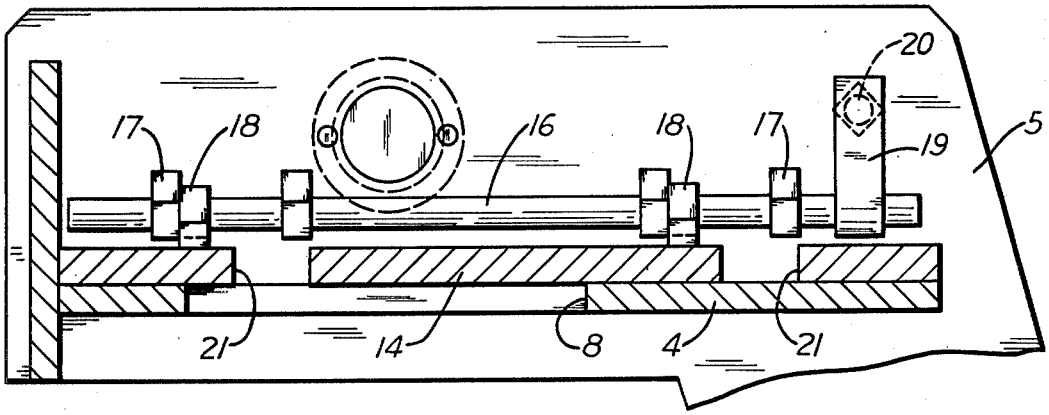

CONTINUOUS CASTING APPARATUS WITH REMOVABLE MOLD

In continuous casting apparatus a mold that is open at both top and bottom is supported by a mold table, to which it is bolted. Molten metal is poured into the top of the mold from a tundish, and a strand of partially solidified metal leaves the lower end of the mold continuously and then is cooled to completely solidify it as it moves along. It becomes necessary at times to replace the mold, such as after a break out of metal. In the past, it has required a considerble amount of time to remove the mold from the table and to replace it with another mold. Of course, to do this, it is first necessary to stop the flow of molten metal into the mold. When metal is being poured from the same tundish into two or more molds simultaneously, taking one mold out of service has required stopping the delivery of metal to the tundish and thus to the rest of the molds, thereby greatly reducing production.

It is among the objects of this invention to provide continuous casting apparatus, in which a mold can be quickly and easily removed when necessary and replaced, and in which this can be done without the other molds fed from the same tundish being out of service very long.

The preferred embodiment of the invention is illustrated in the accompanying drawings, in which FIG. 1 is a side view, partly broken away, of a continuous casting mold and its supporting structure;

FIG. 4 is a vertical section taken on the line IV—IV of FIG. 3.

Figure 2:
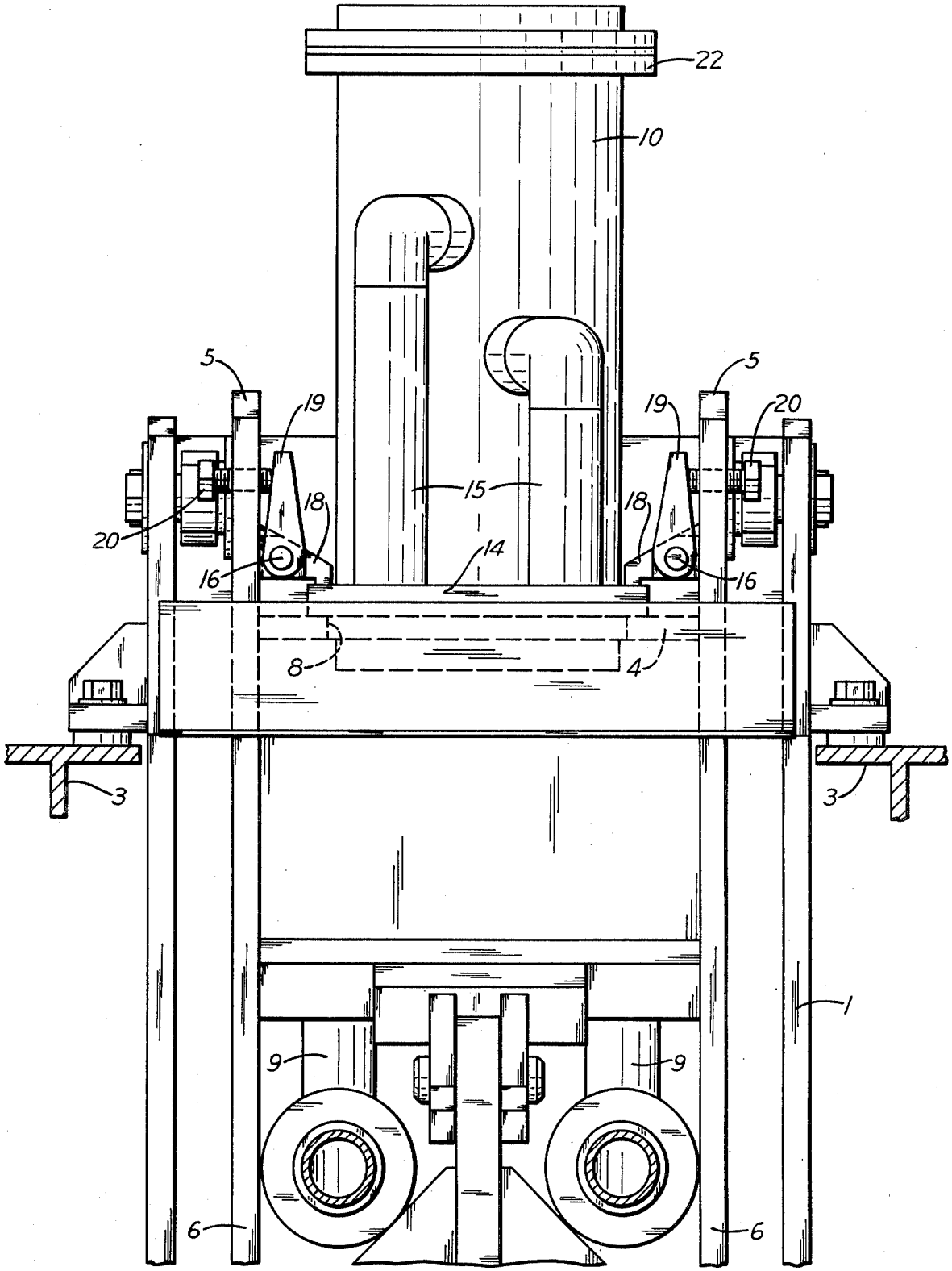
FIG. 2 is an enlarged fragmentary view taken from the operator's end of the apparatus.
Figure 3:
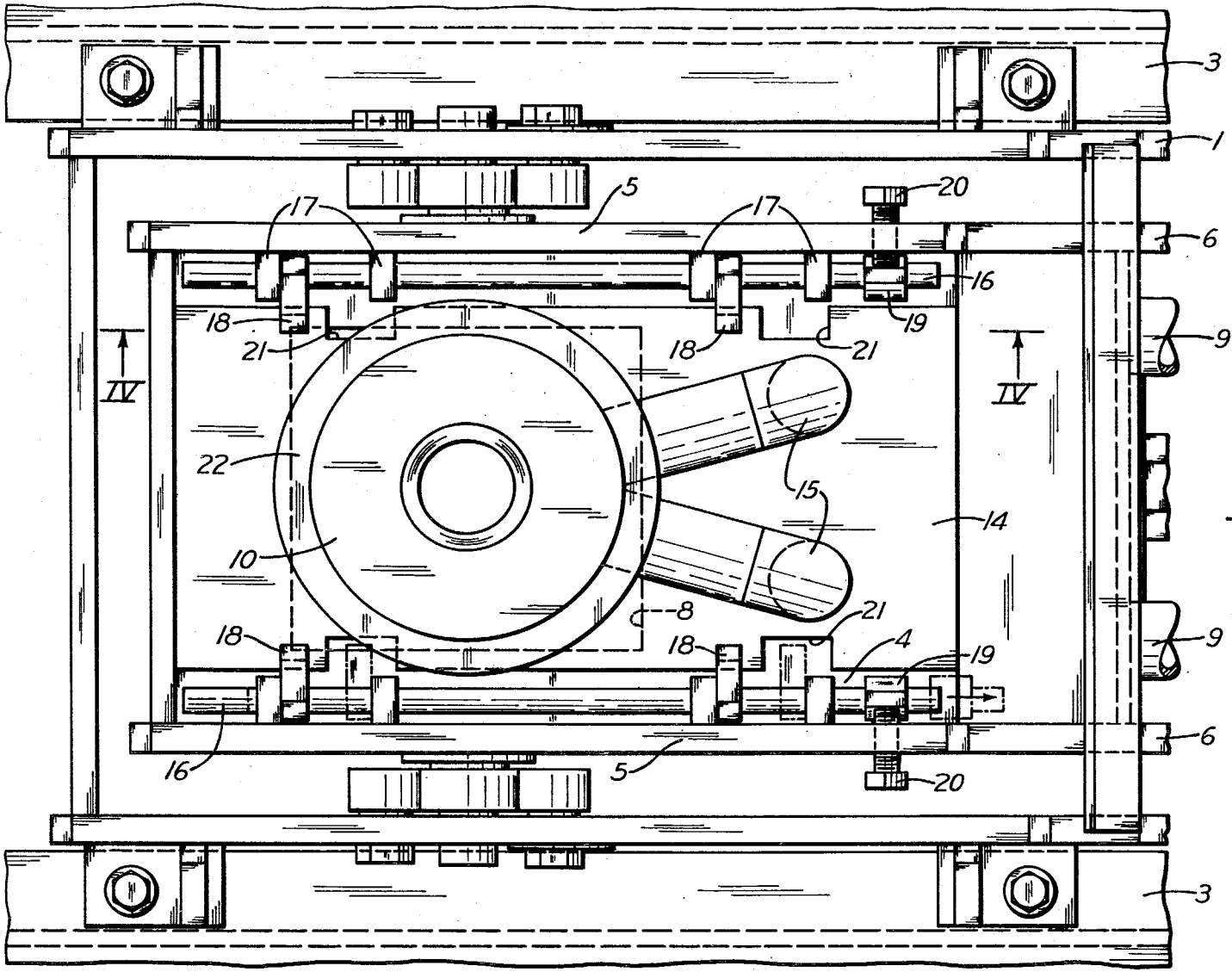
FIG. 3 is a plan view.

Referring to the drawings, a frame 1 is rigidly mounted on a lower beam 2 and a pair of upper beams 3. Between the upper portions of the side walls of this frame a mold table 4 with a flat top is rigidly mounted between side walls 5 that have downwardly extending legs 6 supported in such a manner that the table can be oscillated by a revolving eccentric 7 (FIG. 1), as is customary practice. The two side walls 5 extend above the table, which is provided with a more or less central opening 8 through it. Between this opening and the operator's end of the table it also is provided with a pair of holes, from which pipes 9 extend downwardly for delivering water to a water-cooled continuous casting mold 10 and for returning the water for cooling and recirculation.

The mold, of conventional water-jacketed construction, has its lower end portion rigidly mounted in an opening through a plate 14 that is narrower than the table, on which the plate is seated. This opening is above the large table opening 8 and the mold can extend down through the table a short distance if desired. The plate also is provided with holes registering with the water pipe holes in the table, and the lower ends of short pipes 15 that are connected with the water jacket of the mold are secured to the plate so that water can flow into, through and out of the water jacket.

It is a feature of this invention that extending lengthwise of each side wall 5 of the table, between that wall and the mold-supporting plate 14, there is a shaft 16. This shaft is rotatably and slidably mounted in bearing members 17 secured to the side wall. These bearing members do not overlie the adjacent edge of the plate. Rigidly mounted on each shaft is at least one lug, but preferably two lugs 18, which do overlap the adjacent marginal portion of the plate, against which they are pressed when the shaft is turned in the right direction. The shaft can be turned by an arm 19 rigidly mounted on the end of the shaft at the operator's end of the table. The arm extends upwardly beside the adjacent side wall, and a hand screw 20 is threaded in the wall and engages the upper part of the arm. By tightening the screw against the arm, the lugs are pressed down on the plate to clamp it firmly on the table.

OPERATION

When it becomes desirable or necessary to remove the mold, the hand screws are loosened to release the pressure of the lugs against the mold plate and then the shafts are pulled by arms 19 to move the lugs lengthwise of side walls 5 a predetermined distance to a mold-release position. In this new or release position, the lugs are located directly above notches 21 formed in the marginal portions of the plate. Consequently, the plate can be lifted past the lugs in order to remove the mold from the table.

The plate can be lifted in various ways, but preferably by a fork-lift truck that can project its fork beneath the upper flange 22 of the mold, or beneath lugs on the side of the mold, and then lift it and the plate far enough to clear the rest of the apparatus. Then the truck can back away with the mold, deposit it where desired, pick up a new mold and plate and move them to mold table 4. Following this operation the shafts 16 are pushed back to their original positions and the hand screws are tightened against arms 19 to turn the shafts to press lugs 18 down over the mold plate and thereby clamp it on the table. The entire operation of removing one mold and replacing it with another requires only a few minutes and very little effort, so the casting line is out of service a much shorter length of time than heretofore.

If desired, and if there is sufficient space between the edges of the mold plate and side walls 5 of the oscillating unit to permit the lugs to be swung upwardly far enough to allow the plate to be lifted past them, the edges of the plate will not need to be provided with notches and the rotatable shafts will not have to slide lengthwise in their supporting bearings.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. Continuous casting apparatus comprising a mold table having a substantially horizontal top provided with an opening therethrough, a plate seated on said table top and provided with an opening therethrough above said table opening, a continuous casting mold rigidly mounted on said plate in line with said openings, the table having side walls spaced from two opposite side edges of the plate and extending up above the plate, a shaft extending lengthwise of each side wall between each side wall and the plate, means rotatably connecting the shafts to the adjoining side walls, a lug rigidly mounted on each shaft and projecting laterally therefrom into overlapping relation with the adjacent marginal portion of the plate, means for turning the shafts to press the lugs down upon the plate to clamp the plate on the table, and means for locking the turned shafts against reverse rotation, release of said locking means permitting said plate to be lifted past the lugs to remove the mold from the table.

2. Continuous casting apparatus according to claim 1, in which said locking means include an arm rigidly mounted on one end of each shaft and extending upwardly therefrom, and means connected to the adjacent side wall of said table and removably engaging the side of the arm facing that side wall.

3. Continuous casting apparatus according to claim 2, in which said last-mentioned means is a hand screw extending through said side wall and pressing against the arm.

4. Continuous casting apparatus according to claim 1, in which said shafts are slidable lengthwise to move said lugs a predetermined distance from clamping position to a release position, the plate having notches therein beneath the overlying lugs in said release position so that the plate can be lifted past the lugs.

5. Continuous casting apparatus according to claim 1, in which said shafts are slidable lengthwise to move said lugs a predetermined distance from clamping position to a release position, the plate having notches therein beneath the overlying lugs in said release position so that the plate can be lifted past the lugs, and said locking means include an arm rigidly mounted on one end of each shaft and extending upwardly therefrom, and a hand screw extending through each side wall and pressing against the adjoining arm.

* * * * *